US007527057B2

(12) United States Patent
Fecteau et al.

(10) Patent No.: US 7,527,057 B2
(45) Date of Patent: May 5, 2009

(54) ADJUSTABLE MASK

(75) Inventors: Keith E. Fecteau, Wilbraham, MA (US); Jon Taylor, Groton, MA (US); Dave Honan, Concord, MA (US)

(73) Assignee: 3M Innovative Properties Company, St. Paul, MN (US)

( * ) Notice: Subject to any disclaimer, the term of this patent is extended or adjusted under 35 U.S.C. 154(b) by 821 days.

(21) Appl. No.: 10/200,412

(22) Filed: Jul. 22, 2002

(65) Prior Publication Data

US 2003/0084903 A1 May 8, 2003

Related U.S. Application Data

(60) Provisional application No. 60/307,035, filed on Jul. 20, 2001.

(51) Int. Cl.
*A62B 18/08* (2006.01)

(52) U.S. Cl. ..... 128/206.27; 128/201.24; 128/206.21; 128/206.23; 128/206.24; 128/207.11

(58) Field of Classification Search ..... 128/201.24, 128/206.24, 206.23, 207.11, 206.21, 206.27
See application file for complete search history.

(56) References Cited

U.S. PATENT DOCUMENTS 3,056,402 A * 10/1962 Dickinson ..... 128/206.27
3,079,917 A * 3/1963 Pate ..... 128/206.27
4,000,520 A * 1/1977 Svendsen et al. ..... 2/418
4,664,341 A * 5/1987 Cummings ..... 244/122 AG
5,069,205 A * 12/1991 Urso ..... 128/201.24
5,517,986 A * 5/1996 Starr et al. ..... 128/206.24
5,595,173 A * 1/1997 Dodd, Jr. ..... 128/201.13
5,704,073 A * 1/1998 Sword et al. ..... 2/427
6,119,692 A 9/2000 Byram
6,422,238 B1 * 7/2002 Lithgow ..... 128/207.11

FOREIGN PATENT DOCUMENTS

| | | |
|---|---|---|
| GB | 779943 | 2/1955 |
| GB | 789763 | 9/1956 |
| WO | WO 00/50122 | 2/2000 |

OTHER PUBLICATIONS

PCT/US 02/23117 Search Report mailed Aug. 10, 2002.

* cited by examiner

*Primary Examiner*—Darwin P Erezo
(74) *Attorney, Agent, or Firm*—Cantor Colburn LLP

(57) ABSTRACT

An adjustable mask provides a unique configuration, whereby one hand may be used to both doff the respirator and to securely don the mask. In one embodiment, such configuration is facilitated by a reel attached to one or cords, the cord attached at a second end to a harness designed to engage a portion of the head. Rotation of the reel in one direction causes the one or more cords to tighten, while rotation of the reel in an opposite direction causes the one or more cords to loosen.

23 Claims, 7 Drawing Sheets

ADJUSTABLE MASK

REFERENCE TO RELATED PA TENT APPLICATIONS

The present application claims the priority of U.S. Provisional Patent Application No. 60/307,035, filed Jul. 20, 2001, the entire disclosures of which are specifically incorporated by reference herein.

BACKGROUND

Respirators and masks, particularly fullface designs, are difficult to don and doff. Most have several points of adjustment, usually four or more, all of which have to be pulled in order to tighten the facepiece to the wearer's face when donning, and all of which have to be loosened before the respirator can be removed from the wearer's face. When temporarily or otherwise leaving the contaminated area, the time and complexity of donning and doffing make it difficult for the wearer to take a quick break from the confinement and from the heat which has built up inside of the respirator facepiece.

SUMMARY

The above described disadvantages and problems are alleviated by the present adjustable mask, which advantageously provides a unique configuration, whereby one hand may be used to both doff the respirator and to securely don the mask. In one embodiment, such configuration is facilitated by a reel portion attached to one or more cords, the cord attached at a second end to a harness designed to engage a portion of the head. Rotation of the reel portion in one direction causes the one or more cords to tighten, while rotation of the reel in an opposite direction causes the one or more cords to loosen.

The above description and other features and advantages of the present invention will be appreciated and understood by those skilled in the art from the following detailed description, drawings, and appended claims.

BRIEF DESCRIPTION OF DRAWINGS

Referring now to the drawings wherein like elements are numbered alike in the several FIGURES.

DETAILED DESCRIPTION

Figure 1:
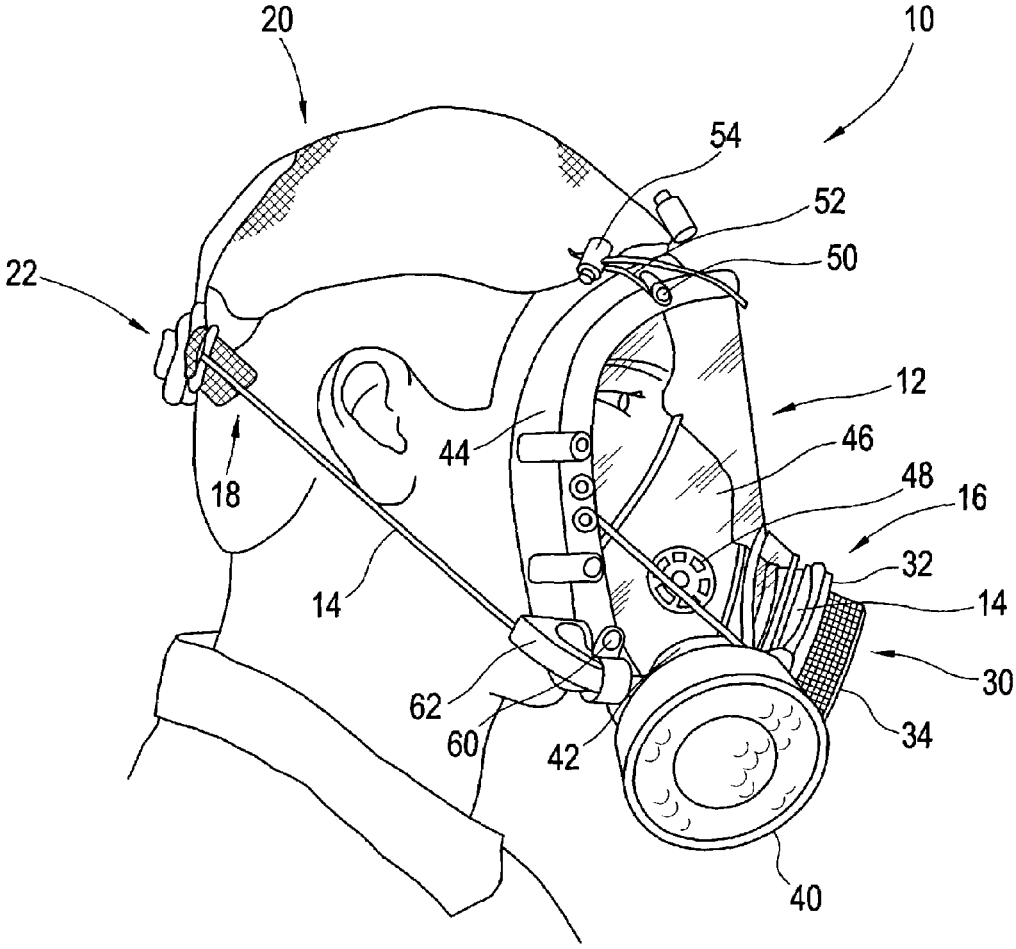
FIG. 1 is a side-perspective view of an exemplary respirator in the donned position.

Referring now to FIG. 1, an exemplary full facepiece respirator 10 is illustrated which allows wearers to quickly don or doff a respirator by the use of one hand and in one continuous motion. The illustrated exemplary mechanism for tightening the facepiece 12 generally comprises a cord means 14 connected at one portion 16 to a reel means 30 and at a second portion 18 to a harness means 20. In the illustrated exemplary embodiment, the reel means 30 comprises a circular ratchet wheel, including a reel mechanism 32, and a cranking mechanism 34, operatively connected to the reel mechanism 32 by a ratchet mechanism (not shown). As illustrated, the reel means 30 is located on the front of the facepiece 12. Rotation of the reel means 30 in one direction causes the reel mechanism 32 to partially take up the cord means 14, which may be a cord, cable, strap or equivalent connector. The cord means 14 engages a portion 22 of the headpiece means 20, so that as the reel mechanism 32 is turned, the cord means 14 is taken up onto the reel mechanism 32 and the length the cord means between the reel mechanism 32 and the harness means 20 is shortened. Shortening of the cord means 14 causes pulling of the facepiece 12 towards the harness means 20 and tightening of the respirator facepiece 12 to the wearer's face.

Referring still to the exemplary embodiment illustrated by FIG. 1, the facepiece 12 is further provided with a first filter cartridge 40 attached to the facepiece 12 by a breating tube 42. The facepiece 12 is further provided with a compliant material 44 along the periphery of the facepiece 12 for good sealing between the facepiece 12 and the face of the user. Inside the facepiece 12 is a mask portion 46 including a gas inlet 48. The facepiece 12 is provided with a first point of attachment 50 with the harness means 20. As shown, the point of attachment connects to a first harness cord 52 with a first harness adjustment means 54. The facepiece 12 similarly provides a second point of attachment 60 for a cord means guide 62, which directs the cord means 14 along the facepiece 12, past the filter 40 and to the reel mechanism 32. While reference is made specifically to the embodiment described by FIGS. 1 and 2, connection of the cord to the harness may also be made by passing cord from a first point of attachment on the facepiece or mask through the harness and back to a second point of attachment on the facepiece or mask.

Figure 2:
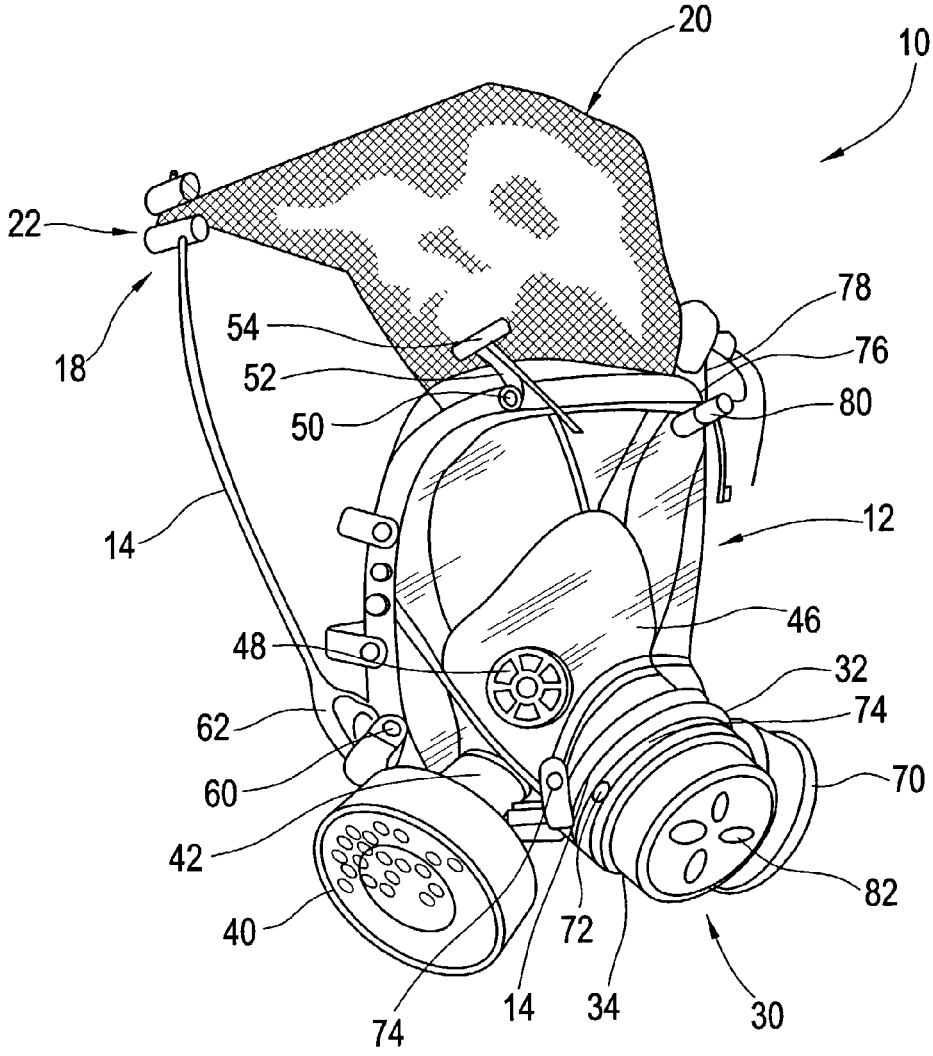
FIG. 2 is an elevated front perspective of the exemplary respirator shown in FIG. 1.

Referring now to FIG. 2, a front elevated perspective view of the respirator is shown. The exemplary respirator 10 includes a second filter cartridge 70 connected to the facepiece 12 by a breathing tube (not shown). The reel mechanism includes a cord connection means 72 for securing the cord the reel means 30. As can bee seen, manipulation of the reel means 30 such that the cord means 14 is tightened causes the cord means 14 to be taken up into a groove 74 on the reel mechanism 32. A third point of attachment 76 is illustrated for securing the cord guide means 62 to the facepiece. A fourth point of attachment 76 is shown on the facepiece 12 for connection with a second harness cord 78 with a second harness adjustment means 80. The reel means 30 includes an internal passageway (not illustrated) in connected to external ports 82 on the reel mechanism 30 for permitting exhalation by the user. The internal passageway further includes a one-way breather valve (not shown) to prevent free passage of ambient air into the mask region.

In one embodiment, such an exemplary respirator may include a reel means which contains gear teeth intermeshing with stationary teeth on the facepiece window. Thus, the reel means is prevented from slipping after the facepiece has been tightened. The reel means may also be spring loaded so that the teeth are engaged unless the reel means is pulled forward and away from the face. Such motion disengages the teeth, allowing the wearer to turn the cranking mechanism or wheel. When the cranking mechanism is released by the wearer, the teeth are again intermeshed and the reel means locks.

In such an embodiment, when doffing the respirator, the wearer simply pulls the reel means away from the face to disengage the teeth. This position allows the reel means to freely turn in a direction which unwinds cord means from the reel. The entire respirator may be completely removed from the head of the wearer by holding on to the reel means and lifting upward. In one aspect, the cord means, which may be but is not limited to a cord, cable, strap or equivalent is made from a semi-rigid, non elastic material which helps to push the headpiece away from the facepiece when the reel means is being turned to release the respirator.

Figure 3:
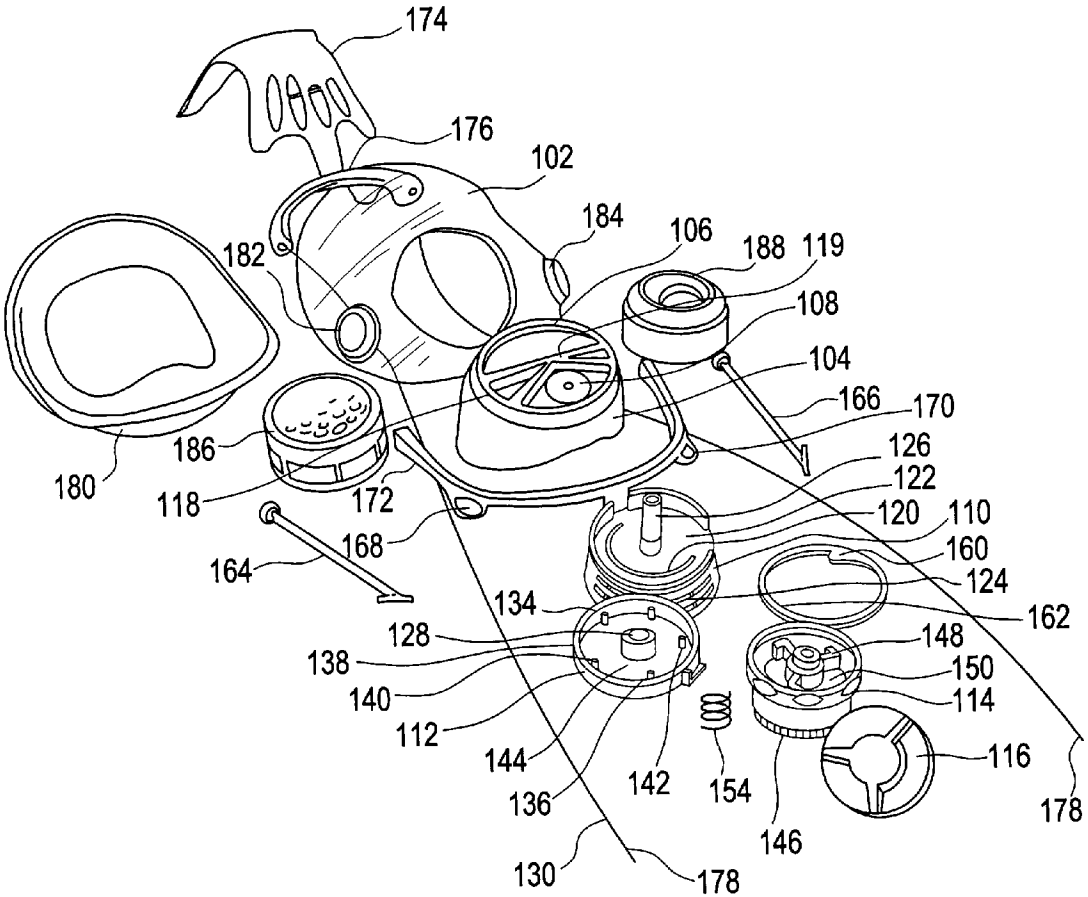
FIG. 3 is an exploded view of an exemplary assembly plan of an exemplary mask.

Referring now to FIG. 3, an exemplary assembly of another exemplary respirator is illustrated generally at 100. The exemplary assembly generally comprises a lens piece 102, a nosecup 104, a voice box 106, an exhalation valve 108, a body 110, a reel 112, a handle 114, and a wingnut 116.

Referring still to FIG. 3, the voicebox 106 forms a gas-tight seal with the lens 102 with an o-ring 118 or equivalent sealing material. The body 110 attaches to the portion of the voice box 106 protruding from the lens piece 102. The voice box 106 includes a threaded aperture 119, which receives a fastener from the wingnut 116, as will be described in greater detail below. The body 110 includes a semicircular track 120 on its face 122, which is configured to engage at least one tooth (not shown) on the underside of the reel 112. The body also includes vents 124 communicating with the exhalation valve 108, such that air can escape through the exhalation valve and through the vents 124. The body also includes a post 126 onto which the reel 112 and handle 114 are positioned.

Figure 7:
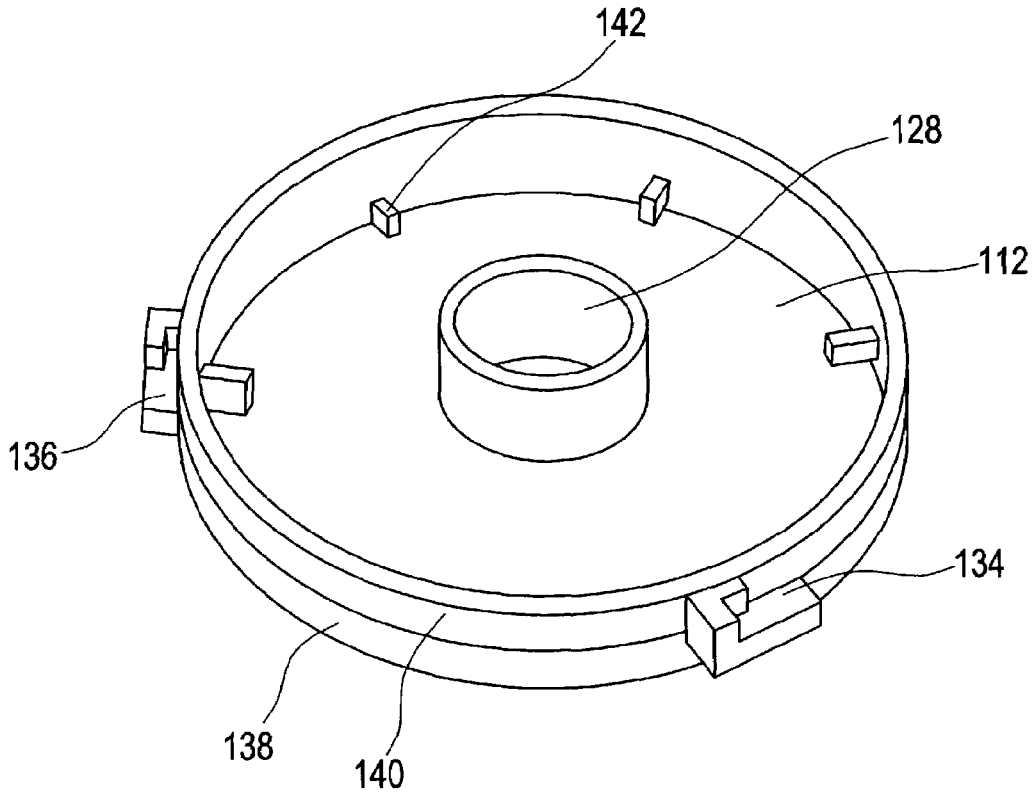
FIG. 7 is an elevation view of an exemplary reel.

Referring to FIGS. 3 and 7, the reel 112 includes an aperture 128, configured to engage the post 126 of the body 110. The reel 112 receives cables 130, 132 at points 134, 136 on the perimeter of the reel 112. The illustrated reel 112 also shows two tracks 138, 140, onto which the cables 130, 132 may wind during rotation of the reel 112. Finally, the reel includes teeth 142 on an upper surface 144 of the reel 112, the teeth 142 configured to engage a plurality of teeth 146 on the lower side of the handle 114.

Referring still to FIG. 3, the handle 114 includes teeth 146, which are selectively engageable with the teeth 142 on the reel 112. In an engaged position, the handle 114 and the reel 112 rotate together. In a disengaged position, wherein the handle is pulled away from the reel 112, the teeth 146 are not engaged with the teeth 142, and the handle 114 may turn independently from the reel 112. In an exemplary embodiment, the handle 114 and the reel 112 are configured such that the reel may only be loosened when the handle is in a disengaged position. Such may be done by providing the handle 114 with a one-way rotation. In such a configuration, when a user desires to loosen the mask, the handle 114 is pulled out, such that the teeth 142, 146 are disengaged, and the cords 130, 132 are pulled such that the reel 112 unwinds.

Figure 4:
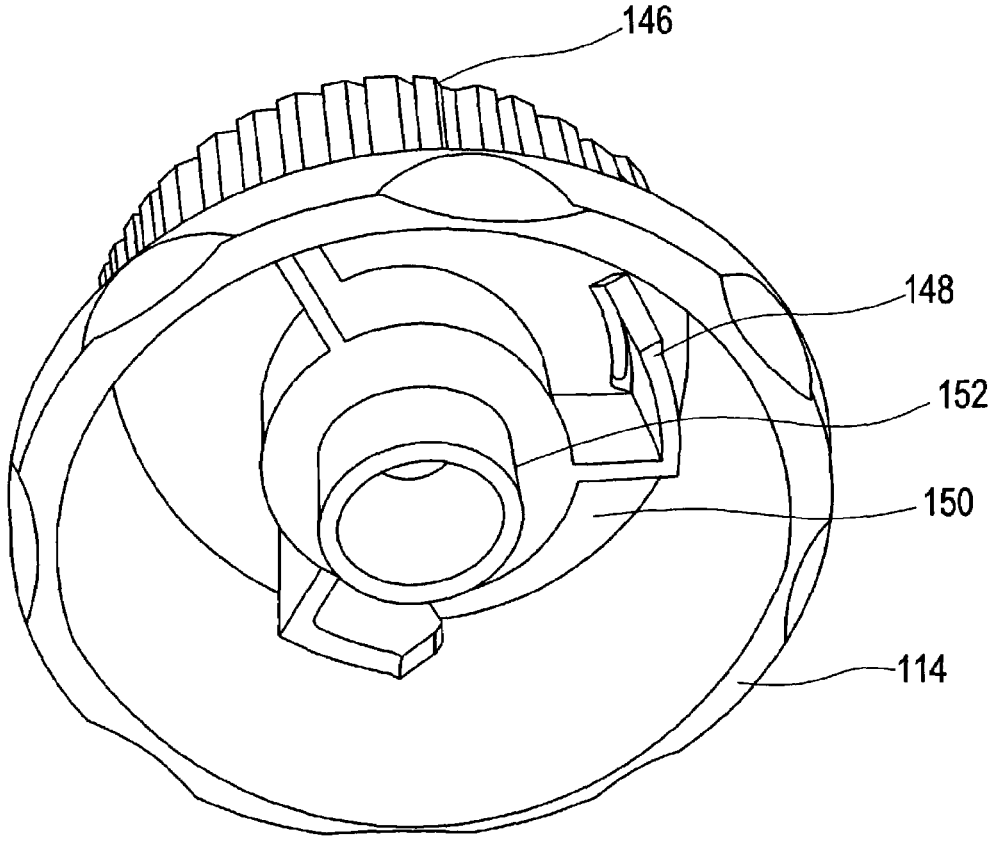
FIG. 4 is a perspective view of an exemplary handle portion.

Referring to FIGS. 3 and 4, the exemplary handle 114 also includes teeth 148 on an upper surface 150 of the handle 114, the teeth 148, configured to engage teeth (158 in FIG. 5) on a lower surface of the wingnut 116. The handle 114 also includes a ledge 152, configured to receive a spring 154 between the ledge and the wingnut 116.

Figure 5:
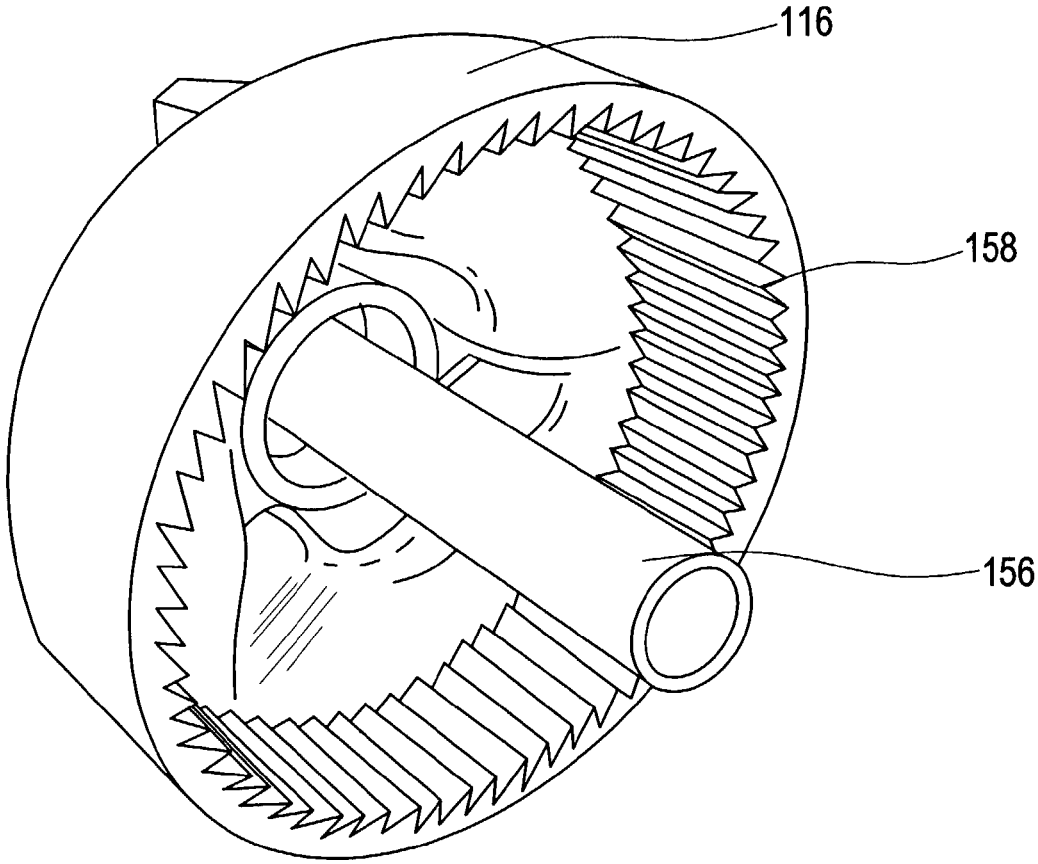
FIG. 5 is an elevation view of an exemplary wingnut portion.

Referring now to FIGS. 3 and 5, a fastener (not shown) extends through member 156, which extends from the lower surface of the wingnut 116, through the spring 154, handle 114, reel 112 and body 110, such that the fastener may fasten into the threaded aperture 119 of the voicebox 106. Thus, the wingnut 116 may provide a tightening force for the assembly, but still allow the handle 114 to be moved relative to the reel 112 such that the cables on the reel 112 may be loosened.

Figure 6:
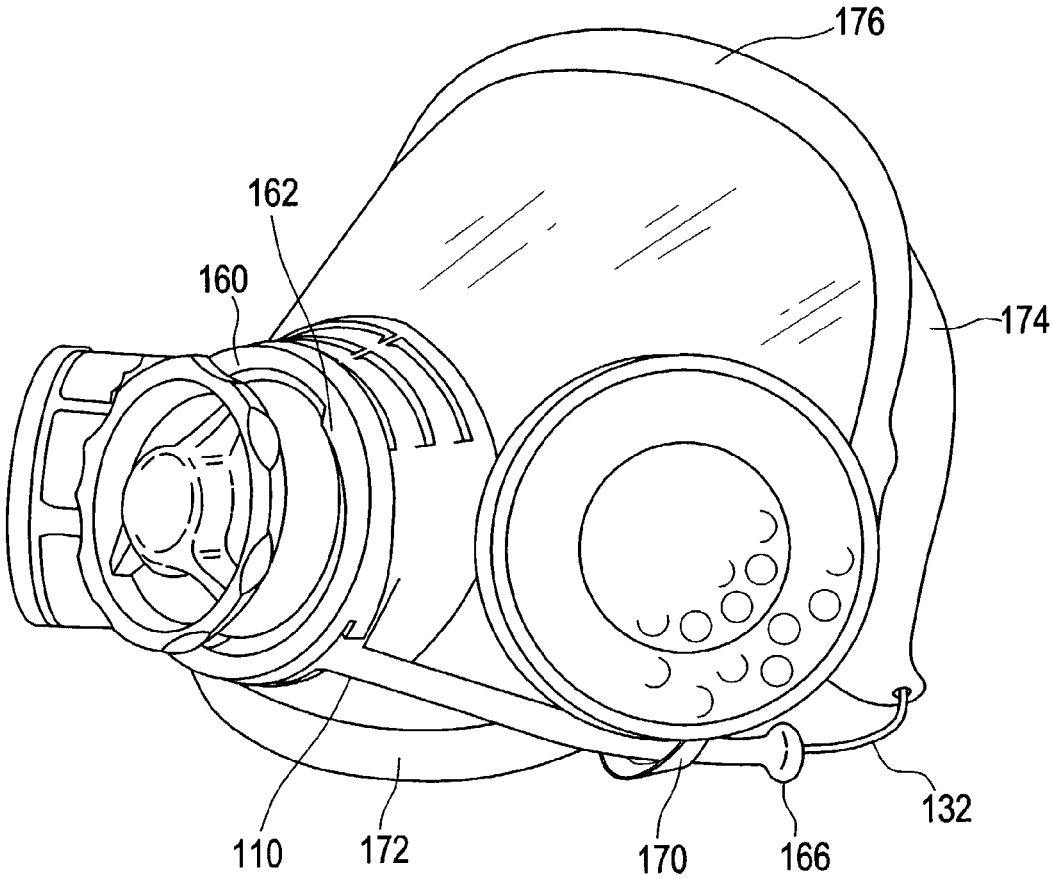
FIG. 6 is an elevation view of an exemplary assembled mask.

Referring now to FIGS. 3 and 6, in another exemplary embodiment, a capstop 160 is positioned over the body 110 and outside of the handle 114. The capstop 160 includes a position marker 162, which in the present embodiment is illustrated as a flared inner region of the capstop 160. The capstop 160 may be provided as a convenience to a wearer, and may be positioned to create a wearer-defined set point or stopping point for the reel 112. As such, it may be used as a compliance device or other indicator that a wearer has rotated the reel 112 all the way to a predetermined set point, where the mask has been shown or proven to fit the wearer. In another embodiment, one or more of the capstop 160, the body 110 or the handle 114 may include marks or gradations indicative of fit or degree or amount of rotation.

Referring again to FIGS. 3 and 6, the cables 130, 132, which are attached to the reel 112 at one end, extend through tube lead-outs 164, 166. The tube lead outs 164, 166 may be attached to the mask by passing through holes 168, 170 in the frame bottom 172. After leaving the tube lead-outs 164, 166, the cables 130, 132 pass through the headgear 174 and into the frame top 176. In another exemplary embodiment, the cables 130, 132 have crimped ends 178 on one or both ends to facilitate attachment to the reel and/or top frame 176 in quick release fashion. Additionally, in another exemplary embodiment, the cables 130, 132 are constructed of a material with low stretchability. In such an embodiment, the cables may be fairly rigid such that the headgear is held open when the cables are fully unwound. Such an embodiment advantageously facilitates donning of the mask by the wearer with one hand.

Referring again to FIG. 3, the faceseal 180 may be attached to the lens 102 by the frame top 176 and frame bottom 172. The frame top 176 and frame bottom 172 may be secured together, for example, by two screws and two nuts (not shown), and the assembled frame may compress the faceseal 180 to the lens 102.

Referring again to FIG. 3, the lens may also include cartridge adapters 182, 184, configured to accept filter cartridges 186, 188. Additionally, one of the lens 102 or voicebox 106 may include an aperture (not shown) for attachment or securing of additional devices, such as a microphone (not shown).

While exemplary embodiments have been shown and described, various modifications and substitutions may be made thereto without departing from the spirit and scope of the invention. Accordingly, it is to be understood that the present invention has been described by way of illustration and not limitation.

The invention claimed is:

1. An adjustable mask, comprising:
a mask portion;
a harness portion;
a cord connected to the harness portion;
a reel portion connected to the cord; and
a handle portion engageable with the reel portion, the handle portion rotatable in only a single direction to effect adjustment of said mask when engaged with the reel portion.

2. The adjustable mask of claim 1, further comprising a faceshield or lens portion associated with said mask portion.

3. The adjustable mask of claim 2, wherein the harness portion extends from an upper portion of the faceshield or lens portion over the top of the head to a back portion of the head.

4. The adjustable mask of claim 3, wherein the harness portion includes at least one point of adjustment, allowing the harness portion to be adjusted according to its relative distance to the facepiece or lens portion.

5. The adjustable mask of claim 1, wherein the cord is a cable having sufficient rigidity to support the harness portion in an open configuration when the adjustable mask is in an open configuration.

6. The adjustable mask of claim 1, wherein the cord is connected to the reel portion at an attachment point and wherein the cord extends to a point of attachment on the harness portion.

7. The adjustable mask of claim 1, wherein the cord extends from an attachment point on the reel portion, further wherein the cord is associated with the harness portion, and further wherein the cord extends from the harness portion back to a point of attachment on a facepiece or lens portion.

8. The adjustable mask of claim 1, further comprising a second cord connected to the harness portion and further connected to the reel portion.

9. The adjustable mask of claim 1, further comprising at least one filter associated with the mask portion.

10. The adjustable mask of claim 1, wherein the reel portion includes at least one track for taking up the cord upon winding of the reel portion.

11. The adjustable mask of claim 1, wherein the reel portion is selectively associated with the handle portion, the handle portion positioned in an accessible position on the mask portion such that a user may turn the handle portion with a hand.

12. The adjustable mask of claim 11, wherein the handle portion rotates only in a single direction, and further wherein the handle portion, when engaged with the reel portion, rotates to wind the cord onto the reel portion.

13. The adjustable mask of claim 12, wherein the reel portion, when disengaged with the handle portion, is rotatable in two directions.

14. The adjustable mask of claim 11, the reel means includes gear teeth selectively engageable wit gear teeth on the handle portion.

15. The adjustable mask of claim 11, wherein the handle portion is operatively associated with a fastening mechanism, the fastening mechanism securely connected to the mask portion. the fastening mechanism permitting only one way turning of the handle portion.

16. The adjustable mask of claim 15, wherein the fastening mechanism includes gear teeth engaged with gear teeth on the handle mechanism, the gear teeth on the fastening mechanism and the gear teeth on the handle mechanism configured to permit only a single direction of rotation of the handle portion.

17. The adjustable mask of claim 14, wherein the reel portion is spring biased against one of the handle portion and the mask portion such that the gear teeth on the reel portion and the gear teeth on the handle portion are biased in an engaged configuration.

18. The adjustable mask of claim 1, further comprising an exhalation port in the mask, the exhalation port facilitating one way movement of gas out of the mask.

19. The adjustable mask of claim 18, wherein the exhalation port is located in the reel portion.

20. The adjustable mask of claim 1, further comprising an indication marker on one or both of the mask portion and the handle portion, the indication marker providing indication of the amount of rotation of die reel portion.

21. The adjustable mask of claim 1, further comprising a rotatable marker piece, the rotatable marker piece positionable on the mask portion, the rotatable marker piece rotatable independently of the reel portion, the rotatable marker piece indicating rotation of the reel portion to or past a pre-selected position.

22. An adjustable mask, comprising:

a mask portion;

a reel means provided on tho adjustable mask;

a handle means, the handle means selectively engageable with the reel means, the handle means rotatable in only a single direction to effect adjustment of said mask when engaged with the reel means;

a head harnzss means; and a cable means.

23. A method of donning a mask, comprising: placing a harness portion over the head of a wearer; and rotating a handle portion to wind a cord about a reel, the cord connected to the harness to draw the mask toward the face of the wearer and to tighten the harness about a back portion of the wearer's head, the handle rotatable in only a single direction to effect adjustment of said mask when engaged with the reel.

* * * * *

UNITED STATES PATENT AND TRADEMARK OFFICE

CERTIFICATE OF CORRECTION

PATENT NO. : 7,527,057 B2
APPLICATION NO. : 10/200412
DATED : May 5, 2009
INVENTOR(S) : Keith E. Fecteau It is certified that error appears in the above-identified patent and that said Letters Patent is hereby corrected as shown below:

Column 1
Line 2, delete "PA TENT" and insert -- PATENT --, therefor.

Column 5
Line 31, in Claim 14, delete "wit" and insert -- with --, therefor.
Line 36, in Claim 15, delete "portion." and insert -- position, --, therefor.

Column 6
Line 17, in Claim 20, delete "die" and insert -- the --, therefor.
Line 26, in Claim 22, delete "tho" and insert -- the --, therefor.
Line 31, in Claim 22, delete "harnzss" and insert -- harness --, therefor.

Signed and Sealed this

Thirtieth Day of June, 2009

John Doll

JOHN DOLL
*Acting Director of the United States Patent and Trademark Office*